US010596404B2

(12) United States Patent
Wallander

(10) Patent No.: US 10,596,404 B2
(45) Date of Patent: Mar. 24, 2020

(54) COMPACT SYSTEM, METHOD, AND DEVICE FOR DEVELOPING MUSCLE MEMORY, TIMING, AND TECHNIQUE FOR USE IN SWING SPORTS

(71) Applicant: William Wallander, Dallas, TX (US)

(72) Inventor: William Wallander, Dallas, TX (US)

( * ) Notice: Subject to any disclaimer, the term of this patent is extended or adjusted under 35 U.S.C. 154(b) by 0 days.

(21) Appl. No.: 16/131,389

(22) Filed: Sep. 14, 2018

(65) Prior Publication Data

US 2019/0083837 A1 Mar. 21, 2019

Related U.S. Application Data

(60) Provisional application No. 62/559,083, filed on Sep. 15, 2017, provisional application No. 62/564,471, filed on Sep. 28, 2017, provisional application No. 62/595,942, filed on Dec. 7, 2017.

(51) Int. Cl.

| | |
|---|---|
| ***A63B 69/00*** | (2006.01) |
| ***A63B 15/00*** | (2006.01) |
| ***A63B 69/36*** | (2006.01) |
| ***A63B 60/46*** | (2015.01) |
| *A63B 71/06* | (2006.01) |
| *A63B 24/00* | (2006.01) |
| *A63B 69/32* | (2006.01) |

(52) U.S. Cl.

CPC ..... *A63B 15/005* (2013.01); *A63B 60/46* (2015.10); *A63B 69/00* (2013.01); *A63B 69/36* (2013.01); *A63B 24/0003* (2013.01); *A63B 69/32* (2013.01); *A63B 2071/0625* (2013.01); *A63B 2071/0655* (2013.01); *A63B 2220/30* (2013.01); *A63B 2220/51* (2013.01); *A63B 2225/09* (2013.01); *A63B 2225/50* (2013.01)

(58) Field of Classification Search

CPC ..... A63B 69/32
USPC ..... 473/231, 232, 457, 239, 219
See application file for complete search history.

(56) References Cited

U.S. PATENT DOCUMENTS

| | | | | | |
|---|---|---|---|---|---|
| 1,020,551 | A | * | 3/1912 | Harania | A61B 5/224 73/379.01 |
| 2,772,887 | A | * | 12/1956 | Blake | A63B 69/0002 473/233 |
| 3,572,706 | A | * | 3/1971 | Schroder | A63B 15/005 473/234 |
| 4,267,793 | A | * | 5/1981 | Lane | A63B 69/0002 116/324 |
| 4,932,661 | A | * | 6/1990 | Choi | A63B 69/3632 473/239 |
| 5,306,010 | A | * | 4/1994 | Choi | A63B 15/005 473/239 |
| 5,360,209 | A | * | 11/1994 | Mollica | A63B 15/005 473/457 |

(Continued)

*Primary Examiner* — Mark S Graham
(74) *Attorney, Agent, or Firm* — Wick Phillips Gould & Martin LLP; Jerry C. Harris, Jr.

(57) ABSTRACT

A device as disclosed herein utilizing a sliding and extendable rod, pipe, piston, or other sliding material designed to develop muscle memory, strength, technique, and flexibility for square swing impact and extension to enhance coordination and power, as well as to provide rehabilitative training based on repetition with immediate tactile, auditory, impact, and visual feedback, and that enables the user to train in partial swing and full swing modes and can be utilized indoors and outdoors.

12 Claims, 4 Drawing Sheets

(56) References Cited

U.S. PATENT DOCUMENTS

| | | | | |
|---|---|---|---|---|
| 5,505,454 | A * | 4/1996 | Gagarin | A63B 15/00 473/232 |
| 6,705,952 | B1 * | 3/2004 | Vecsey | A63B 15/005 473/232 |
| 7,621,859 | B2 * | 11/2009 | Kim | A63B 15/005 482/139 |
| 8,414,412 | B2 * | 4/2013 | Kim | A63B 15/005 473/234 |
| 9,561,417 | B2 * | 2/2017 | Rodriguez | A63B 69/0002 |
| 9,757,634 | B1 * | 9/2017 | Fierro | A63B 71/0622 |
| 2010/0041500 | A1 * | 2/2010 | Whitney | A63B 15/005 473/457 |
| 2011/0034275 | A1 * | 2/2011 | Kim | A63B 15/005 473/457 |

* cited by examiner

COMPACT SYSTEM, METHOD, AND DEVICE FOR DEVELOPING MUSCLE MEMORY, TIMING, AND TECHNIQUE FOR USE IN SWING SPORTS

CROSS-REFERENCE TO RELATED APPLICATIONS

The present application claims priority to U.S. Provisional Patent Application Ser. No. 62/559,083 filed Sep. 15, 2017 by William Wallander and entitled "A Compact System, Method, and Device for Developing Muscle Memory, Timing, and Technique for Square Power Golf Hitting and Proper Extension," and claims priority to U.S. Provisional Patent Application Ser. No. 62/564,471 filed Sep. 28, 2017 by William Wallander and entitled "A Compact System, Method, and Device for Developing Muscle Memory, Timing, and Technique for Square Power Sports Hitting and Extension," and claims priority to U.S. Provisional Patent Application Ser. No. 62/595,942 filed Dec. 7, 2017 by William Wallander and entitled "A Compact System, Method, and Device for Developing Muscle Memory, Timing, and Technique for Use in Sports Swing," which are all incorporated herein by reference as if reproduced in their entirety.

BACKGROUND

A successful sports swing impact requires square impact to the target of the swing, e.g., a ball, puck, or shuttlecock, with full arm and hand extension based on proper swing timing, technique, square target hitting, proper extension, muscle memory, repeatability, and confidence—all delivered in the short period of time it takes to make the square swing impact. Square swing impact will enable the player to direct the swing target to its intended destination, and critical to square swing impact is proper release into and extension through the target. Repeatability of square swing impact requires trained swing timing, technique, square target hitting, proper extension, muscle memory, repeatability, and confidence to consistently deliver square swing impact. Square swing impact can be successfully executed when the athlete has confidence to swing without the need to think about swing mechanics, thus performing square swing impact with subconscious support to maximize physical skill and intuitive mental abilities in support of successful shot completion. Keeping it simple and confident can help increase square swing impact, leading to improved technique, target striking performance, and play improvement. The compact swing trainer can be used for any sports swing including without limitation golf, baseball, softball, tee-ball, stickball, cricket, lacrosse, tennis, squash, racquetball, badminton, hockey, field hockey, lacrosse, and polo.

SUMMARY

In an embodiment, a swing square impact and swing extension development device may comprise one or more housing components; an extendable and retractable component configured to retract and extend within the one or more housing components; one or more friction components positioned between the extendable and retractable component and an interior of the housing component, configured to retard movement of the extendable and retractable component with respect to the housing component, wherein the friction components are configured to allow the extendable and retractable component to extend within the housing component when a predetermined amount of force is applied by a user; and one or more extension termination components attached to the extendable and retractable component and configured to engage or contact a portion of the housing component to prevent any further extension of the extendable and retractable component from the housing component.

In an embodiment, a method for training movement of a sports swing user's feet, legs, hips, hands, arms, shoulders, and back may comprise containing an extendable and retractable component configured to retract and extend within one or more housing components; providing friction between the extendable and retractable component and an interior of the housing component via one or more friction components; allowing the extendable and retractable component to extend within the housing component(s) whenever sufficient force is applied from a user's swing of the housing component to overcome the friction from the one or more friction components; providing a tactile response to the user when the extendable and retractable component extends within the housing, thereby indicating a predicted desired point of contact during a sports swing; and preventing the extendable and retractable component from further extension out of the housing by one or more extension termination components attached to the extendable and retractable component and configured to engage or contact a portion of the housing component.

In an embodiment, a method for training movement of a sports swing user's feet, legs, hips, hands, arms, shoulders, and back may comprise containing an extendable and retractable component configured to retract and extend within one or more housing components; providing friction between the extendable and retractable component and an interior of the housing component via one or more friction components; allowing the extendable and retractable component to extend within the housing component(s) whenever sufficient force is applied from a user's swing of the housing component to overcome the friction from the one or more friction components; providing a tactile response to the user when the extendable and retractable component extends within the housing, thereby indicating a predicted desired point of contact during a sports swing; and preventing the extendable and retractable component from further extension out of the housing by one or more extension termination components attached to the extendable and retractable component and configured to engage or contact a portion of the housing component.

BRIEF DESCRIPTION THE DRAWINGS

DETAILED DESCRIPTION

Figure 1:
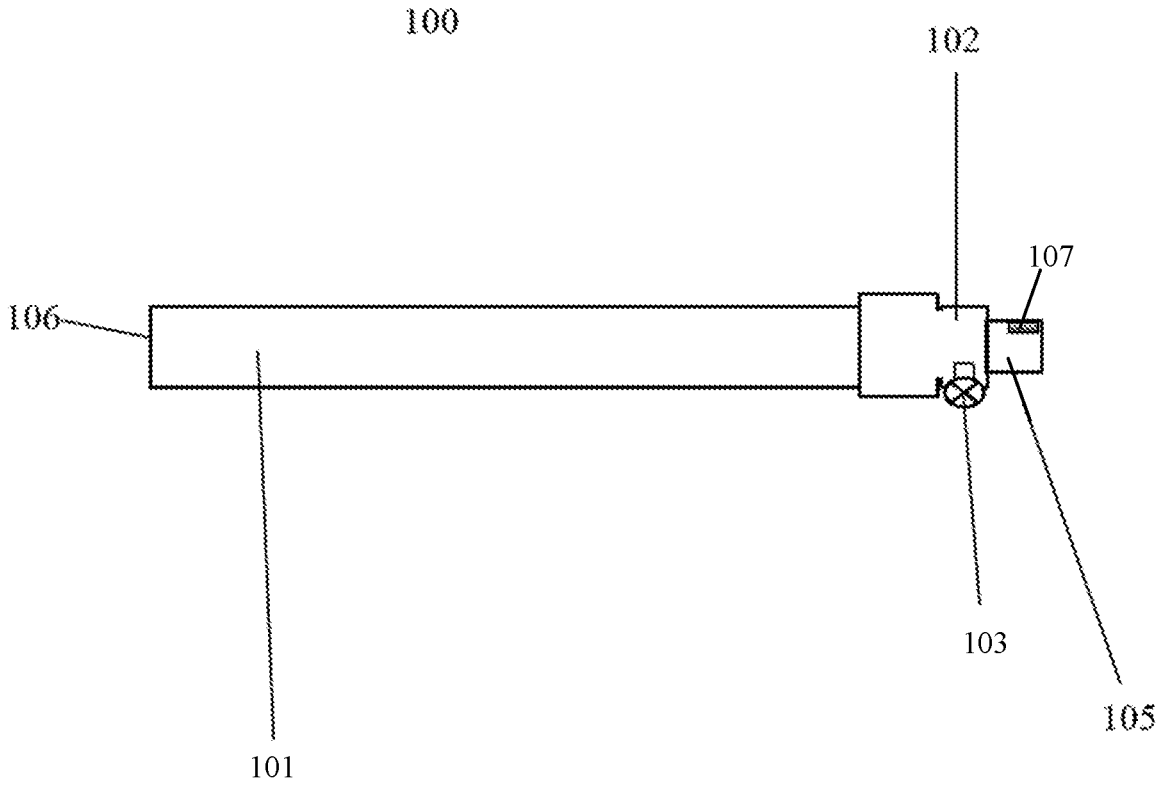
FIG. 1 illustrates an embodiment of a square swing impact development device in a first, retracted position, according to an embodiment of the disclosure.

A device as disclosed herein utilizing a sliding and extendable rod, pipe, piston, or other sliding material designed to develop muscle memory, strength, technique, and flexibility for square swing impact and extension to enhance coordination and power, as well as to provide rehabilitative training based on repetition with immediate tactile, auditory, impact, and visual feedback, and that enables a user to train in partial swing and full swing modes and can be utilized indoors and outdoors.

The square swing impact technique is a complex movement that is best accomplished by the interaction of the alternating contraction and relaxation of various muscle groups. Because this movement occurs in less than two seconds and must be coordinated to the millisecond, it cannot be controlled by conscious thought. It must be trained in harmony with the subconscious mind. Thus while in training, it is desirable that athletes have continuous information and feedback throughout the entire movement that they are maintaining the correct relationship between the feet, legs, hips, torso, arms, neck, and head when making the square swing impact, all of which are facilitated by use of the disclosed device.

One facet of the uniqueness of the disclosed device, method, and system is that all of the needed muscle groups to effectuate the square swing impact, and to develop muscle memory, strength, technique, and flexibility for square swing impact to enhance coordination and power, as well as to provide rehabilitative training are worked, trained, and developed. The disclosed device, method, and system also permit the user to practice square swing impact without the need for open space, that is, the device, method, and system can be used indoors to improve square swing impact, whether as part of training itself, or while doing other activities such as watching television.

Use of the device method, and system provide immediate tactile, auditory, impact, and visual feedback to the user to help the user confirm proper technique and to do repetitions of the technique and thus improve technique, strength, muscle memory, and confidence. Use of the device method, and system provide also provide a compact swing trainer stick if held in the inverted and extended portion. The device method, and system focus on improved method training of the core and other muscles used in making the sports swing, with focus on those utilized for square swing impact. By use of the device method, and system in a controlled manner, the athlete is able to train strength, flexibility, technique, coordination, weight shift, rhythmic timing, repeatability, and confidence.

The device is a compact combination of materials, whether tubes, shafts, or other materials, that slide and extend when the proper square swing technique is made. The device provides immediate tactile, auditory, impact, and visual feedback to the user to help the user confirm proper technique and to do repetitions of the technique and thus improve technique, strength, muscle memory, and confidence. The timing is related to proper release and extension of the hands, wrists, and arms in the golf or other sports swing to effectuate and complete square impact.

The device also provides feedback concerning swing speed, swing velocity, swing force, swing energy, and energy transfer via a data measurement component integrated and/or attachable to the device, wherein the data measurement component may communicate with a user's smart phone, tablet, watch, or other computer device to provide user with information and analysis concerning the user's swing dynamics.

Figure 2:
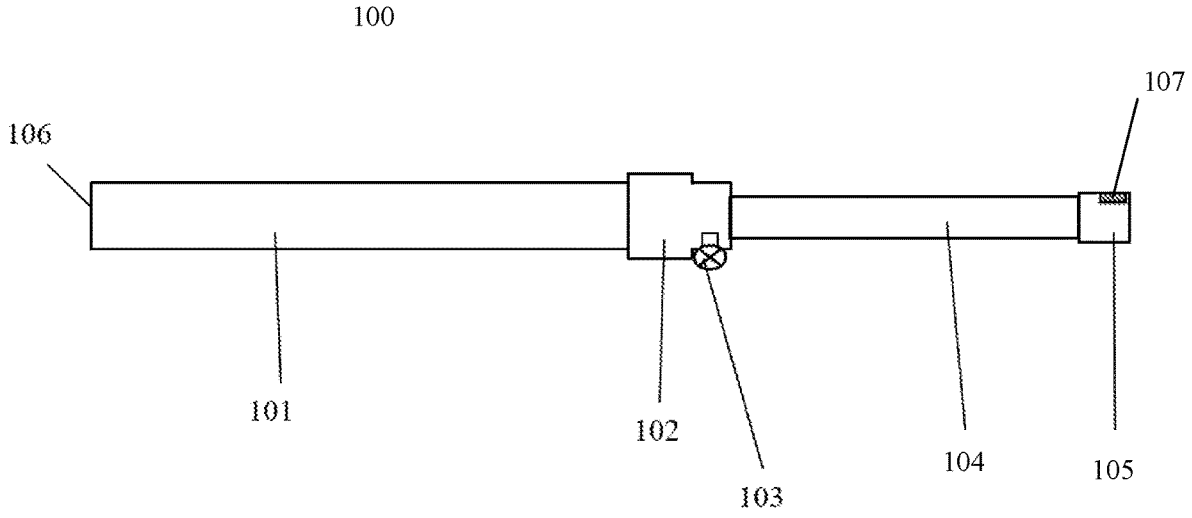
FIG. 2 illustrates an embodiment of a square swing impact development device in a second, extended position, according to an embodiment of the disclosure.

As shown in FIGS. 1 and 2, the disclosed compact swing trainer 100 (which may also be known as a swing square impact and swing extension development device, or development device) may comprise at least one outer housing component 101, a coupling component 102, a tensioning component 103, an extendable and retractable component 104, and an interchangeable terminus component 105. FIG. 1 illustrates a first, retracted position of the extendable and retractable component 104 with respect to the at least one housing component 101, while FIG. 2 illustrates a second, extended position of the extendable and retractable component 104 with respect to the at least one housing component 101.

The extendable and retractable component 104 may be positioned within at least a portion of the at least one outer housing component 101, and the coupling component 102 may attach the at least one outer housing component 101 to the extendable and retractable component 104. The tensioning component 103 may be positioned to affect the movement of the extendable and retractable component 104 with respect to the housing component 101. The interchangeable terminus component 105 may be positioned at one end of the extendable and retractable component 104.

The components of the disclosed compact swing trainer 100 can be fashioned from metal, plastic, cloth, wood, alloy, composite, polymer, and/or a combination of said materials. As one of ordinary skill in the art would understand, the components of the compact swing trainer 100 may be fashioned into various shapes and lengths, wherein the shapes and lengths provide for the extendable and retractable component 104 to retract and extend within the outer housing component 101. In an embodiment the extendable and retractable component 104 and the outer housing component 101 comprise hollow polymer cylinders.

As shown in FIGS. 1 and 2, tensioning component 103 passes through coupling component 102 to engage and/or contact the extendable and retractable component 104. In an embodiment coupling component 102 may be fashioned from one or more polymers. The tensioning component 103 may be fashioned from metal, plastic, wood, alloy, composite, polymer, or a combination of said materials. The tensioning component 103 can be fashioned into various shapes and lengths, wherein the shapes and lengths provide for the tensioning component 103 to adjustably retard the movement of the extendable and retractable component 104 with respect to the housing component 101. In an embodiment, tensioning component 103 comprises a screw having a manipulatable head.

In some embodiments, the tensioning component 103 can be adjusted to prohibit the extension of the extendable and retractable component 104 until between approximately 1 and 1000 N of force (e.g., between approximately 0.2 pound force and 230 pound force) is applied/exerted on the interchangeable terminus component 105. In some embodiments, the tensioning component 103 can be adjusted to prohibit the extension of the extendable and retractable component 104 until approximately 200 N of force is applied/exerted on the interchangeable terminus component 105. In some embodiments, the tensioning component 103 can be adjusted to prohibit the extension of the extendable and retractable component 104 until approximately 500 N of force is applied/exerted on the interchangeable terminus component 105. In some embodiments, the tensioning component 103 can be adjusted to prohibit the extension of the extendable and retractable component 104 until approximately 750 N of force is applied/exerted on the interchangeable terminus component 105. The tensioning component 103 can be calibrated for adjustment to various force values which correspond to the required force to cause the extendable and retractable component 104 to extend based on which interchangeable terminus component 105 is attached. For example, for a simulated golf swing (wherein the interchangeable terminus component 105 may be a golf club), the tensioning component 103 may be calibrated for less than approximately 500 N, while for a simulated baseball swing (wherein the interchangeable terminus component 105 may be a baseball bat), the tensioning component 103 may be calibrated for higher than approximately 500 N. Additionally, different types of golf clubs may require different swing forces, wherein the interchangeable terminus component 105 may comprise one of a plurality of golf clubs, each with a separate calibration force for the tensioning component 103.

As shown in FIGS. 1 and 2, the interchangeable terminus component 105 may be affixed to the extendable and retractable component 104. The interchangeable terminus component 105 may be fashioned from metal, plastic, wood, cloth, alloy, composite, polymer, or a combination of said materials. The interchangeable terminus component 105 can be fashioned into various shapes and sizes. In an embodiment, interchangeable terminus component 105 can comprise the shape of the head of a golf club, e.g., the head of a wood, iron, wedge, hybrid, chipper, putter, or other shape suitable to the sport for which the compact sports swing trainer. In an embodiment, interchangeable terminus component 105 can comprise the shape of a ball. In an embodiment, interchangeable terminus component 105 can comprise a swing data measurement component 107 configured to detect and/or sense characteristics of a user's swing movement or motion. In an embodiment the swing data measurement component 107 may comprise a computer processor, memory, executable instructions, other hardware, and/or combinations thereof which cause the swing data measurement component 107 to measure, record, and communicate swing data, e.g., swing speed, swing velocity, swing force, swing energy, and energy transfer, to the user. In an embodiment, the swing data measurement component 107 may comprise one or more communication modules and may be configured to communicate with a user's smart phone, tablet, watch, or other computer device via Bluetooth communication, near field communication (NFC), Wi-Fi communication, satellite communication, cellular communication, or combinations thereof. In an alternative embodiment, the swing data measurement component 107 may be integrated with, or removably attached to, the outer housing component 101, the coupling component 102, the tensioning component 103, the an extendable and retractable component 104, or combinations thereof.

Figure 3:
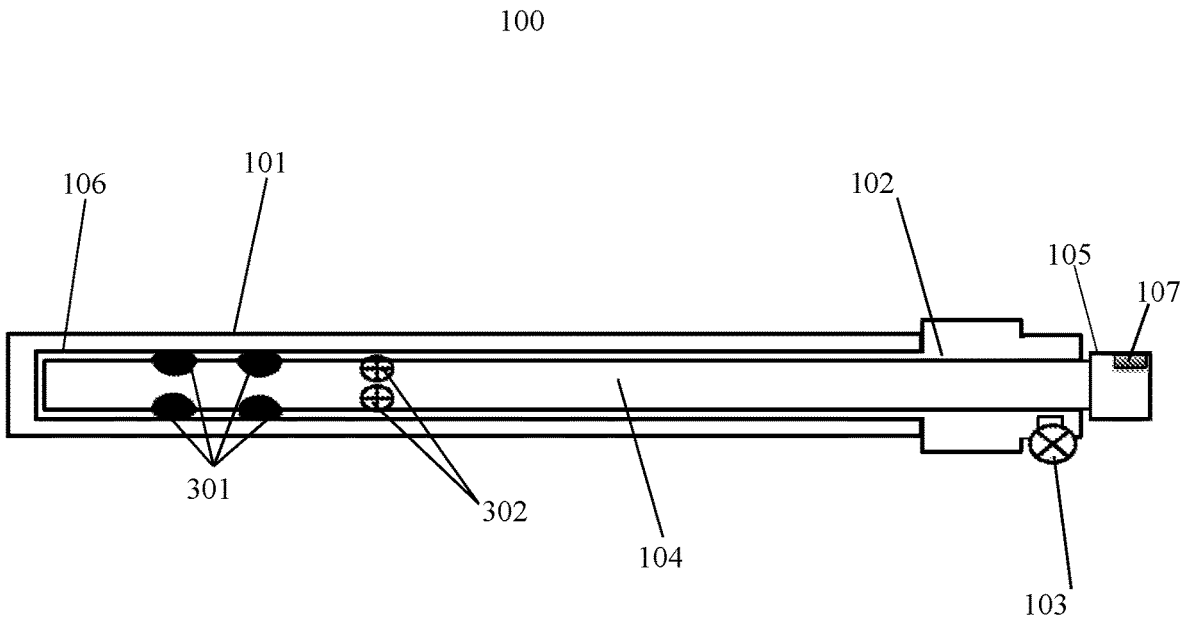
FIG. 3 illustrates a cross-sectional (interior) view of a square swing impact development device in a first, retracted position, according to an embodiment of the disclosure.
Figure 4:
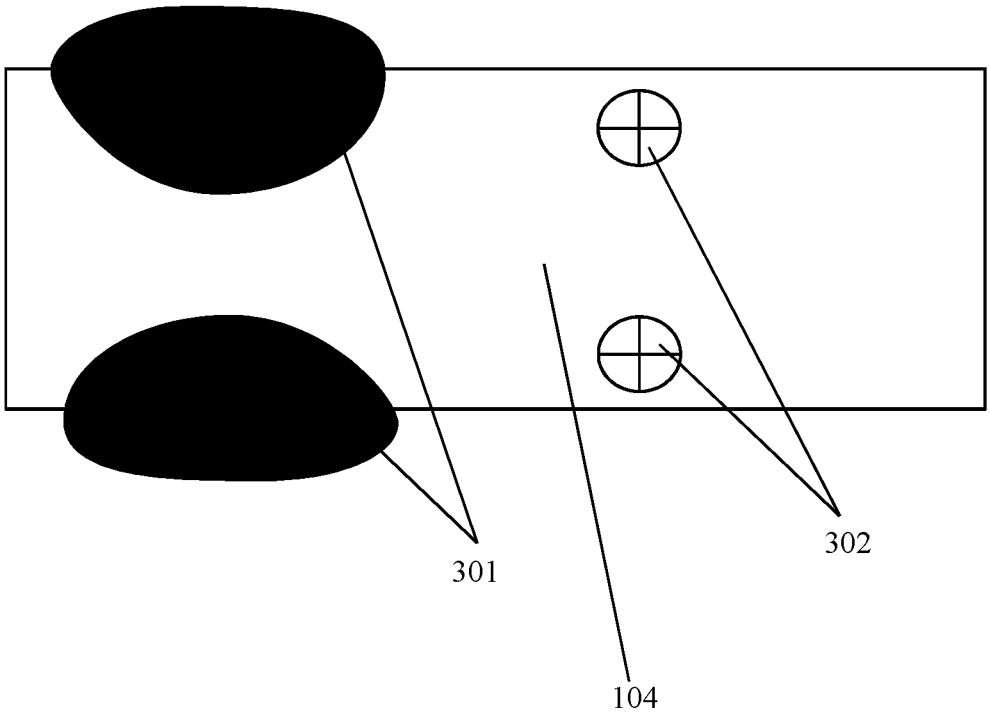
FIG. 4 illustrates a detailed view of the extendable and retractable component of a square swing impact development device, according to an embodiment of the disclosure.

As shown in FIGS. 3 and 4, the extendable and retractable component 104 may comprise one or more friction components 301. The friction component 301 may be fashioned from metal, plastic, cloth, wood, alloy, composite, polymer, or a combination of said materials. The friction component 301 may be fashioned in any shape which allows the friction component 301 to engage and/or contact the outer housing component's interior 106, as shown in FIG. 4. In an embodiment, the outer housing component's interior 106 may comprise one or more friction components 301, which are fashioned to engage and/or contact the extendable and retractable component 104. In an embodiment, both the extendable and retractable component 104 and the outer housing component's interior 106 comprise one or more friction components 301. The one or more of the friction components 301 may be positioned on the extendable and retractable component 104 and the outer housing component's interior 106 at any location or locations to ensure the friction components 301 engage/contact the other component (i.e., the extendable and retractable component 104 and the outer housing component's interior 106) to retard the movement of the extendable and retractable component 104.

As shown in FIGS. 3 and 4, the extendable and retractable component 104 comprises extension termination components 302. The extension termination component 302 may be fashioned from metal, plastic, cloth, wood, alloy, composite, polymer, or a combination of said materials. The extension termination component 302 may be fashioned in any shape which allows the extension termination component 302 to engage and/or contact the coupling component 102 and, at point of engagement/contact, prevent any further extension of the extendable and retractable component 104 from the outer housing component 101.

In an embodiment, the compact swing trainer 100 does not comprise a tether, bungee, or other similar component for automatically, or without user impetus, retracting the retractable component 104 into the outer housing component 101. In some embodiments, the compact swing trainer 100 does not comprise an internal snap back cord.

The disclosed compact swing trainer 100 may be used for training movement of a sports swing user's feet, legs, and hips, hands, arms, shoulders, and back by the sports swing user making practice swings in partial and full swings, from slow motion to full speed swings.

The disclosed compact swing trainer 100 may be used for training movement of a sports swing user's initial backswing by the sports swing user taking the compact swing trainer 100 to waist level without releasing the internal sliding component. The disclosed compact swing trainer 100 may be used for training movement of a sports swing user's upper backswing by the sports swing user taking the compact swing trainer 100 to the top of the backswing and holding it there without releasing the internal sliding component. The disclosed compact swing trainer 100 may be used for training movement of a sports swing user's top of the backswing by the sports swing user taking the compact swing trainer 100 to the top of the backswing and holding the top position without releasing the internal sliding component.

The disclosed compact swing trainer 100 may be used for training movement of a sports swing user's initial downswing by the sports swing user taking the compact swing trainer 100 into the initial downswing without releasing the internal sliding component. The disclosed compact swing trainer 100 may be used for training movement of a sports swing user's lower downswing by the sports swing user taking the compact swing trainer 100 into the lower downswing and letting the hands extend to commence the release of the internal sliding component.

The disclosed compact swing trainer 100 may be used for training movement of a sports swing user's impact area by the sports swing user taking the compact swing trainer 100 into the impact area while letting the hands and arms extend to release of the internal sliding component. The disclosed compact swing trainer 100 may be used for training movement of a sports swing user's initial position of swing follow through by the sports swing user taking the compact swing trainer past the impact area and into the initial swing follow through while maintaining the extension and release of the hands and arms. The disclosed compact swing trainer 100 may be used for training movement of a sports swing user's swing follow through to a swing finish position by the sports swing user completing the swing to the top finish position.

The disclosed compact swing trainer 100 may be used for training a sports swing user to hold a swing finish position by the sports swing user and holding the top finish position.

The disclosed compact swing trainer 100 may be used for training a sports swing user to effectuate any of the above in slow, moderate, or full speed swings, or partial swings, in particular the motion of swinging from "waist to waist" to accentuate the release motion of the arms and hands through the impact area to full extension. The disclosed compact swing trainer 100 may be used for training a sports swing user to effectuate any of the above or others specific to the specific sport in slow, moderate, or full speed swings, or partial swings, in particular motion to accentuate the release and extension motion of the arms and hands through the impact area to full extension.

Having described various devices and methods herein, exemplary embodiments or aspects can include, but are not limited to:

In a first embodiment, a swing square impact and swing extension development device may comprise one or more housing components; an extendable and retractable component configured to retract and extend within the one or more housing components; one or more friction components positioned between the extendable and retractable component and an interior of the housing component, configured to retard movement of the extendable and retractable component with respect to the housing component, wherein the friction components are configured to allow the extendable and retractable component to extend within the housing component when a predetermined amount of force is applied by a user; and one or more extension termination components attached to the extendable and retractable component and configured to engage or contact a portion of the housing component to prevent any further extension of the extendable and retractable component from the housing component.

A second embodiment can include the device of the first embodiment, further comprising a tensioning component located within the one or more housing components configured to contact the extendable and retractable component and configured to adjustably retard the movement of the extendable and retractable component with respect to the housing component.

A third embodiment can include the device of the first or second embodiments, further comprising a coupling component configured to attach the extendable and retractable component to the one or more housing components.

A fourth embodiment can include the device of the third embodiment, wherein the one or more extension termination components are configured to interact with the coupling component to prevent the extendable and retractable component from moving completely out of the housing component.

A fifth embodiment can include the device of any of the first through fourth embodiments, further comprising an interchangeable terminus component affixed to the extendable and retractable component.

A sixth embodiment can include the device of the fifth embodiment, wherein the interchangeable terminus component comprises can comprise the shape of the head of a golf club, e.g., the head of a wood, iron, wedge, hybrid, chipper, putter, or other shape suitable to the sport for which the compact sports swing trainer.

A seventh embodiment can include the device of the fifth or sixth embodiment, wherein the interchangeable terminus component comprises a swing data measurement component.

An eighth embodiment can include the device of any of the first through seventh embodiments, wherein the one or more friction components are attached to the extendable and retractable component and configured to engage or contact an interior of the housing component.

A ninth embodiment can include the device of any of the first through eighth embodiments, wherein the housing is configured to be held in a user's hands, wherein at the beginning of a user's swing, the extendable and retractable component is in a first, retracted position, wherein during the user's swing the extendable and retractable component extends to a second, extended position.

A tenth embodiment can include the device of the ninth embodiment, wherein the extendable and retractable component is held in the first, retracted position by the one or more friction components, wherein the user's applied a force to the extendable and retractable component due to the user's swing movement, and wherein the force applied by the user causes the extendable and retractable component to overcome the friction of the one or more friction components to move to the second, extended position.

An eleventh embodiment can include device of the ninth or tenth embodiment, wherein the extendable and retractable component moves from the first, retracted position to the second, extended position at a predicted desired point of contact during a sports swing, and thereby provides a tactile response to the user when the extendable and retractable component extends within the housing.

A twelfth embodiment can include the device of any of the first through eleventh embodiments, wherein the development device does not comprise a tether, bungee, internal snap back chord, or other component for automatically, or without user impetus, retracting the retractable component into the housing component.

In a thirteenth embodiment, a method for training movement of a sports swing user's feet, legs, hips, hands, arms, shoulders, and back may comprise containing an extendable and retractable component configured to retract and extend within one or more housing components; providing friction between the extendable and retractable component and an interior of the housing component via one or more friction components; allowing the extendable and retractable component to extend within the housing component(s) whenever sufficient force is applied from a user's swing of the housing component to overcome the friction from the one or more friction components; providing a tactile response to the user when the extendable and retractable component extends within the housing, thereby indicating a predicted desired point of contact during a sports swing; and preventing the extendable and retractable component from further extension out of the housing by one or more extension termination components attached to the extendable and retractable component and configured to engage or contact a portion of the housing component.

A fourteenth embodiment can include the method of the thirteenth embodiment, further comprising adjustably retarding the movement of the extendable and retractable component by a tensioning component located within the one or more housing components.

A fifteenth embodiment can include the method of the thirteenth or fourteenth embodiments, wherein providing a tactile response comprises allowing the extendable and retractable component to move from a first, retracted position to a second, extended position with respect to the housing component(s).

A sixteenth embodiment can include the method of any of the thirteenth through fifteenth embodiments, wherein preventing the extendable and retractable component from further extension out of the housing comprises interacting, by the coupling component, with the one or more extension termination components.

A seventeenth embodiment can include the method of the sixteenth embodiment, wherein preventing the extendable and retractable component from further extension out of the housing comprises interacting, by the coupling component, with the one or more extension termination components.

An eighteenth embodiment can include the method of any of the thirteenth through seventeenth embodiments, further comprising measuring one or more characteristics of the user's swing via an interchangeable terminus component comprising a swing data measurement component, wherein the interchangeable terminus component is attached to the extendable and retractable component.

A nineteenth embodiment can include the method of any of the thirteenth through eighteenth embodiments, further comprising retracting the extendable and retractable component within the housing within the use of a tether, bungee, internal snap back chord, or other component for automatically, or without user impetus, retracting the retractable component into the housing component.

In a twentieth embodiment, a method for training movement of a sports swing user's feet, legs, hips, hands, arms, shoulders, and back may comprise training movement of a sports swing user's initial backswing; training movement of a sports swing user's upper backswing; training a sports swing user to hold the top of a backswing; training movement of a sports swing user's initial downswing; training movement of a sports swing user's lower downswing; training a sports swing user to hold the impact of a sports swing; training movement of a sports swing user's initial position of swing follow through; training movement of a sports swing user's swing follow through to a swing finish position; training a sports swing user to hold a swing finish position; and training a sports swing user to swing from "waist to waist" to accentuate the release motion of the arms and hands through the impact area to full extension.

What is claimed is:

1. A swing square impact and swing extension development device comprising:

one or more housing components;

a couple component;

an extendable and retractable component configured to retract and extend within the one or more housing components and the coupling component;

a tensioning component configured to pass through the coupling component and to contact the extendable and retractable component;

one or more friction components positioned between the extendable and retractable component and an interior of the housing component, configured to retard movement of the extendable and retractable component with respect to the housing component, wherein the friction components are configured to allow the extendable and retractable component to extend within the housing component when a predetermined amount of force is applied by a user; and one or more extension termination components attached to the extendable and retractable component and configured to engage or contact a portion of the housing component to prevent any further extension of the extendable and retractable component from the housing component.

2. The development device of claim 1, wherein the tensioning component is configured to adjustably retard the movement of the extendable and retractable component with respect to the housing component.

3. The development device of claim 1, wherein the coupling component s configured to attach the extendable and retractable component to the one or more housing components.

4. The development device of claim 3, wherein the one or more extension termination components are configured to interact with the coupling component to prevent the extendable and retractable component from moving completely out of the housing component.

5. The development device of claim 1, further comprising an interchangeable terminus component affixed to the extendable and retractable component.

6. The development device of claim 5, wherein the interchangeable terminus component comprises can comprise the shape of the head of a golf club, e.g., the head of a wood, iron, wedge, hybrid, chipper, putter, or other shape suitable to the sport for which the compact sports swing trainer.

7. The development device of claim 5, wherein the interchangeable terminus component comprises a swing data measurement component.

8. The development device of claim 1, wherein the one or more friction components are attached to the extendable and retractable component and configured to engage or contact an interior of the housing component.

9. The development device of claim 1, wherein the housing is configured to be held in a user's hands, wherein at the beginning of a user's swing, the extendable and retractable component is in a first, retracted position, wherein during the user's swing the extendable and retractable component extends to a second, extended position.

10. The development device of claim 9, wherein the extendable and retractable component is held in the first, retracted position by the one or more friction components, wherein the user applies a force to the extendable and retractable component due to the user's swing movement, and wherein the force applied by the user causes the extendable and retractable component to overcome the friction of the one or more friction components to move to the second, extended position.

11. The development device of claim 9, wherein the extendable and retractable component moves from the first, retracted position to the second, extended position at a predicted desired point of contact during a sports swing, and thereby provides a tactile response to the user when the extendable and retractable component extends within the housing.

12. The development device of claim 1, wherein the development device does not comprise a tether, bungee, internal snap back chord, or other component for automatically, or without user impetus, retracting the retractable component into the housing component.

* * * * *